United States Patent [19]

Smith

[11] Patent Number: 4,509,392

[45] Date of Patent: Apr. 9, 1985

[54] DEVICE FOR EXTRACTING VALVE PACKING

[76] Inventor: Edgar L. Smith, 102 East Liberty, Savannah, Ga. 31401

[21] Appl. No.: 533,800

[22] Filed: Sep. 19, 1983

[51] Int. Cl.[3] ..... B25B 27/00

[52] U.S. Cl. ..... 81/8.1; 81/302

[58] Field of Search ..... 81/8.1, 302

[56] References Cited

U.S. PATENT DOCUMENTS

| | | | |
|---|---|---|---|
| 717,526 | 1/1903 | Barney | 81/302 |
| 919,808 | 4/1909 | Bales | 81/8.1 |
| 1,858,176 | 5/1932 | Webb | 81/8.1 |
| 2,207,661 | 7/1940 | Dugan | 81/8.1 |
| 2,401,043 | 5/1946 | Bowman et al. | 81/8.1 |
| 3,138,045 | 6/1964 | Ourada | 81/8.1 |
| 3,651,717 | 3/1972 | Johnson, Jr. | 81/8.1 |
| 3,861,248 | 1/1975 | Bushinsky | 81/8.1 |

*Primary Examiner*—Roscoe V. Parker

*Attorney, Agent, or Firm*—James J. Brown

[57] ABSTRACT

A device is described for cutting and extracting packing from around a shaft such as a valve stem whereby compression of the handles of the device causes an elongated cutter to penetrate and cut the packing material. The device is characterized by having a cutting head which partially encircles the shaft and which can be exchanged for other, similar shaped cutting heads having elongated cutters of different dimensions for use in cutting and removing packing of varying size.

4 Claims, 5 Drawing Figures

Fig. 3
Fig. 1
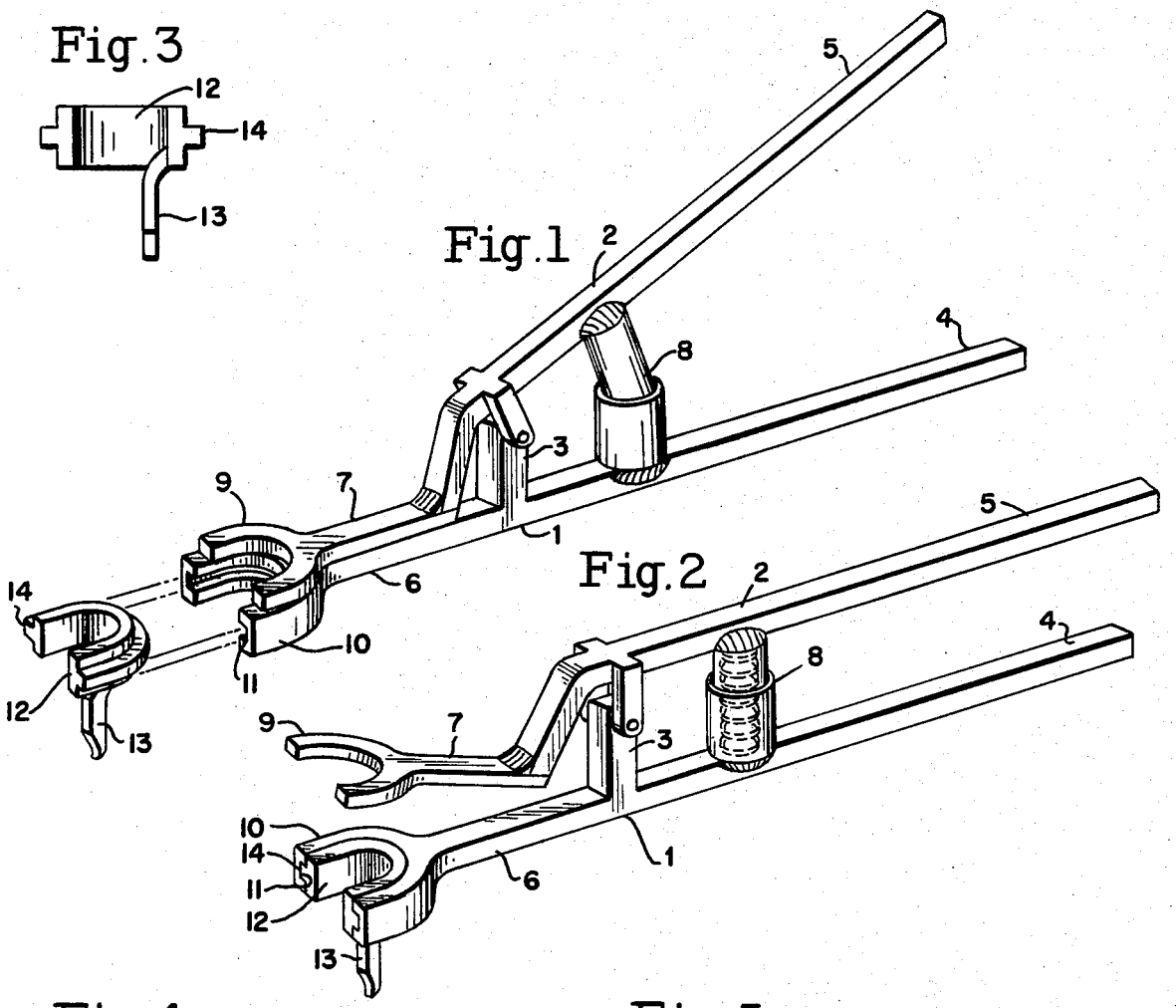
Fig. 2
Fig. 4
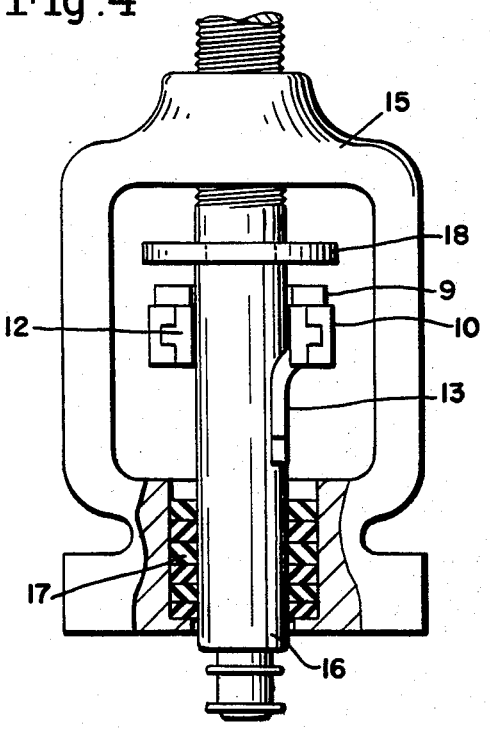
Fig. 5
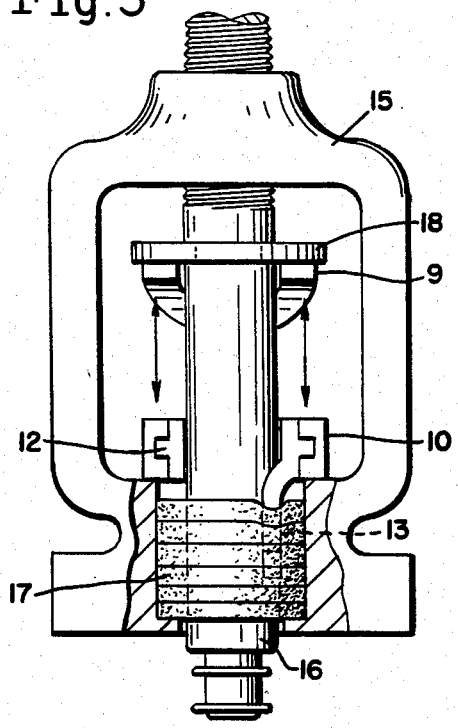

DEVICE FOR EXTRACTING VALVE PACKING

SUMMARY OF THE INVENTION

The present invention is directed to a device for cutting and extracting packing or other material from around a shaft such as commonly found in a high pressre steam valve. More particularly, the present invention is directed to a cutting and extracting tool which is adapted to employ various size cutting heads and which can be easily manipulated to facilitate the removal of packing from around a shaft such as a high pressure valve shaft.

BACKGROUND OF THE INVENTION

Various devices have been employed for the removal of packing material from around shafts such as those found in valves. Typically, these devices have consisted of augers, picks, "corkscrew" shaped devices and other similar implements for cutting, tearing or picking at the packing material which is disposed around a valve shaft. These devices have the disadvantage that they require considerable manipulation in the often limited space in which the valve packing is found.

Typical, for example, of the devices heretofore employed for removing valve packing are the devices described in the following U.S. patents:

U.S. Pat. No. 3,861,248 to Bushinsky describes a tool for extracting packing from a gland which comprises a curved, pointed shaft adapted to be inserted into the packing material and then twisted to extract the packing.

U.S. Pat. No. 3,651,717 to Johnston, Jr. describes a packing extractor which employs a curved, pointed device to entwine concentrically the valve shaft and be rotated down into the packing material.

Additional patents which describe similar devices for removing packing are U.S. Pat. No. 2,207,661 to Dugan, U.S. Pat. No. 1,858,176 to Webb, and U.S. Pat. No. 919,808 to Bales.

It is accordingly an object of the present invention to provide an improved device for extracting packing material from around a valve stem or shaft which can easily be manipulated in the restricted area where the packing is found by a single hand operation.

It is yet a further object of the present invention to provide a device for removing packing from around a valve stem which avoids the necessity for complex manipulation of the device and permits a rapid complete and efficient removal of the packing material in a single operation.

BRIEF DESCRIPTION OF THE DRAWINGS

FIG. 1 is a perspective view of the invention with the cutter removed from the collar.

FIG. 2 is a perspective view of the invention with the handles compressed and the cutter placed in the collar.

FIG. 3 is a front elevational view of a typical cutter.

FIG. 4 is an elevational view of a typical valve with a portion broken away to show the packing in section plus the end of the tool in place against the shaft.

FIG. 5 is a view similar to FIG. 4 but showing the packing in elevation with the tool compressed and penetrating the packing.

DETAILED DESCRIPTION OF THE INVENTION

The above-noted and other objects are achieved in accordance with the present invention by providing a device for cutting and extracting packing material from around a shaft such as a valve stem such as the type commonly found in high pressure steam valve fittings. The device of the present invention essentially comprises a pair of elongated levers which are disposed in opposed spaced relationship to one another and connected by a fulcrum which is disposed between the two levers at a point intermediate the two ends of each lever. The opposing portions of the respective levers on one side of the fulcrum comprises handles such that compression thereof causes the other opposing ends of the levers to separate. Each of the other opposing lever ends which are remote from the handles form a collar adapted to partially enclose the valve shaft or stem from which the packing material is to be removed. These two collars are both semi-circular in configuration and in a plane perpendicular to the plane of movement of the levers when they are compressed or released. One of the collars disposed at the end of the one lever is also adapted to hold a removable cutting head for actually penetrating and cutting the packing material disposed around the shaft. The portion of the cutting head which fits into the collar is also semi-circular in configuration and adapted to partially fit around the shaft. Projecting downward from this portion of the cutting head and the collar which holds it is a sharp, elongated projection which is positioned to be displaced downward along the shaft when the handles of the device are compressed to penetrate the packing material disposed around the shaft. Once penetration of the packing material has been achieved by compressing the handles of the device to force the end of the lower lever downward along the shaft, the entire device can be rotated partially around the valve shaft in a lateral direction so that the sharp projecting cutter further cuts and displaces the packing material. Where packing material of substantial depth is encountered, it is an advantage of the present invention that cutting heads having downward cutting projections of different length can be rapidly exchanged in the cutting head holder of the device. In some instances for example, it may be desirable to employ cutting heads of several different sizes to completely and thoroughly remove the packing material in a particular valve.

DETAILED DESCRIPTION OF THE DRAWINGS

The present invention will however be more fully appreciated by having reference to the following detailed description of the drawings.

Directing attention to FIGS. 1 and 2 of the drawings, a pair of opposed levers, 1 and 2, are joined together by a fulcrum 3 at a point intermediate their respective ends. Opposing portions, 4 and 5, of the two levers disposed on one side of the fulcrum provide handles such that compression together of the two handles causes a separation of the other two opposed ends 6 and 7 on the other side of the fulcrum of the respective levers. Conveniently, a return tensioning device 8 is provided between the handles such as a spring for maintaining the handles in a spaced relationship so that the ends of the levers remote from the handles are essentially kept together. Disposed at the end of the upper lever 7 remote from the handle is a semi-circular collar 9 having a plane perpendicular to the plane of movement of the handles of the device and adapted to encircle the shaft or stem from which packing material is to be cut and removed. Conveniently, this upper collar 9 and the attached portion of the lever 7 is off-set from the rest of the lever 2 so that it is essentially parallel in its rest position from a lower collar 10 attached to the end 6 of the lower lever 1 remote from its handle. This lower collar also has a plane perpendicular to the plane of movement of the levers and is also adapted to partially encircle the shaft or stem from which the valve packing is to be removed.

The lower collar is however provided with a concave annular slot 11 or other means for accommodating and holding a cutting head 12 having a downwardly extending projection 13 which is positioned such that compression of the handles of the device causes the projection to move along with the lower collar 12 downward along the shaft so that it penetrates the packing material located below the collar around the shaft. The cutting head itself can be seen to be a semi-circular ring to which is attached on one side an elongated downwardly projection cutter 13 which extends in a plane perpendicular to that of the ring and the collar which holds it and essentially in the same direction as the plane of movement of the handles of the device during compression. A second, more narrow, annular ring 14 is disposed on the outside of the ring and adapted to fit in the slot 11 provided in the collar. It will of course be understood that other means can be provided for actually holding the cutting head in a removable position however, the present configuration facilitates rapid interchange of cutting heads having different length cutting projections to facilitate removal of packing material placed at various depths around the valve shaft.

The actual use of the device of the present invention in cutting and removing packing from around a valve stem will, however, be more fully appreciated by referring to FIGS. 4 and 5 of the drawings. In these figures, a valve housing 15 is disposed around a valve shaft 16 with packing 17 shown in cross-section around the lower portion of the valve stem 16. In FIG. 4 the respective collars 9 and 10 of the device are shown in a relaxed position around the valve shaft 16 with the cutting head 12 disposed within the collar 10. The downwardly projecting cutter 13 extends vertically along the shaft 16. In FIG. 5 of the drawings, the handles of the device have been compressed to cause separation of the upper and lower collars 9 and 10 respectively. The upper collar 9 essentially either remains stationary around the shaft 17 or moves upward until it encounters a projection 18 around the valve shaft which prevents further upward movement. The lower collar 10, however, is displaced downward along the shaft 17 away from the upper collar 9 in such a way that the downwardly projecting cutter 13 penetrates the packing 17. In this manner and by manipulating the device laterally around the valve shaft 16 a number of penetrations of the packing material can quickly and efficiently be made to facilitate its removal. The devise itself may also be turned in a lateral direction once the cutter has penetrated the packing material to further facilitate cutting and displacement of the packing material. As already noted, in instances where valve packing of differing or greater depth is encountered around a shaft, heads having cutting projections of different lengths can quickly and easily be inserted into the lower collar so that progressively deeper penetration of the valve packing can quickly be achieved.

It will be apparent, from the above description, that various modifications and adaptations can be made in the device of the present invention without departing from the intended scope thereof.

What is claimed is:

1. A device for cutting and extracting packing from around a shaft comprising a pair of elongated levers disposed in opposed, spaced relationship to one another and connected by fulcrum means disposed between the levers at respective points intermediate the ends thereof, one pair of the respective opposing portions of the levers on one side of said fulcrum means forming handles such that compression thereof causes the other opposing portions of the levers on the other side of the fulcrum to separate, one of the ends of said other opposing portions being provided with a semicircular collar means for partially, slidably encircling the shaft from which packing is to be removed, said collar having a plane perpendicular to the plane of movement of said levers, second semicircular collar means being disposed on the opposing end of said other lever and adapted to also slidably encircle a portion of said shaft and to hold elongated means for cutting and removing packing from around said shaft, said cutting means being adapted to fit in said second collar and project downward therefrom parallel to said shaft such that compression of the handle portion of said levers causes said elongated cutting means to be displaced downward along side shaft and to penetrate padding disposed around said shaft and below the collar.

2. The device of claim 1 wherein return means is provided between said pair of levers to force said opposing handles apart.

3. The device of claim 1 wherein said second collar means is provided with an annular slot to receive and hold said cutting means.

4. The device of claim 3 wherein said cutting means is a further semi-circular collar adapted to fit within said second semi-circular collar means and provided with an annular ring disposed around the outer periphery thereof and adapted to fit within said annular slot in said second collar means, said cutting means including a downwardly extending projection means for penetrating and cutting said packing.

* * * * *